US006827432B2

(12) United States Patent
King et al.

(10) Patent No.: US 6,827,432 B2
(45) **Date of Patent: *Dec. 7, 2004**

(54) REPLACEABLE INK CONTAINER FOR AN INKJET PRINTING SYSTEM

(75) Inventors: Dale King, Corvallis, OR (US); Scott D Sturgeon, Vancouver, WA (US); David C Johnson, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 63 days.

This patent is subject to a terminal disclaimer.

(21) Appl. No.: 10/305,884

(22) Filed: Nov. 27, 2002

(65) Prior Publication Data

US 2003/0081088 A1 May 1, 2003

Related U.S. Application Data

(63) Continuation of application No. 09/495,288, filed on Jan. 31, 2000, now Pat. No. 6,431,697, and a continuation of application No. 09/496,169, filed on Jan. 31, 2000, now Pat. No. 6,508,547.

(51) Int. Cl.[7] ..... B41J 2/175
(52) U.S. Cl. ..... 347/86
(58) Field of Search ..... 347/19, 49, 50, 347/86, 85, 87

(56) References Cited

U.S. PATENT DOCUMENTS

| | | | | |
|---|---|---|---|---|
| 5,138,344 A | * | 8/1992 | Ujita | 347/86 |
| 5,182,581 A | | 1/1993 | Kashimura et al. | |
| 5,619,237 A | | 4/1997 | Inoue et al. | |
| 5,619,239 A | | 4/1997 | Kotaki et al. | |
| 5,629,725 A | * | 5/1997 | Buican | 347/49 |
| 5,784,088 A | | 7/1998 | Ujita et al. | |
| 5,788,388 A | | 8/1998 | Cowger et al. | |
| 5,798,777 A | * | 8/1998 | Yoshimura et al. | 347/44 |
| 5,812,156 A | | 9/1998 | Bullock et al. | |
| 5,835,817 A | | 11/1998 | Bullock et al. | |
| 5,847,731 A | | 12/1998 | Kashimura et al. | |
| 6,102,533 A | | 8/2000 | Nozawa et al. | |
| 6,155,678 A | | 12/2000 | Komplin et al. | |
| 6,196,670 B1 | | 3/2001 | Saruta | |
| 6,431,697 B1 | | 8/2002 | King et al. | |
| 6,508,547 B2 | * | 1/2003 | King et al. | 347/86 |

FOREIGN PATENT DOCUMENTS

| | | |
|---|---|---|
| EP | 0812693 A1 | 12/1997 |
| EP | 0829363 A2 | 3/1998 |

* cited by examiner

*Primary Examiner*—Anh T. N. Vo

(57) ABSTRACT

The present invention disclosure relates to a replaceable ink container for providing ink to an inkjet printing system. The inkjet printing system has a receiving station mounted to a scanning carriage. The receiving station has a fluid inlet and a pair of guide rails extending along either side of the fluid inlet. The replaceable ink container includes a fluid outlet configured for connection to the fluid inlet associated with the receiving station. Also included is a pair of outwardly extending guide rail engagement features. Each of the pair of guide rail engagement features are so disposed and arranged on the replaceable ink container for engagement with each of the pair of guide rails to guide the replaceable ink container in both horizontal and vertical directions into the receiving station. The pair of outwardly extending guide rail engagement features and the pair of guide rails cooperate to align the fluid outlet with the fluid inlet to establish fluid communication between the ink container and the receiving station.

14 Claims, 9 Drawing Sheets

REPLACEABLE INK CONTAINER FOR AN INKJET PRINTING SYSTEM

CROSS REFERENCE TO RELATED APPLICATIONS

The present application is a continuation of U.S. patent application Ser. No. 09/495,288 filed Jan. 31, 2000 now U.S. Pat. No. 6,431,697, entitled "Replaceable Ink Container Having A Separately Attachable Latch" which has been assigned to the same Assignee as the present application and is a continuation of Ser. No. 09/496,169 filed Jan. 31, 2000 and U.S. Pat. No. 6,508,547.

BACKGROUND OF THE INVENTION

The present invention relates to ink containers for providing ink to inkjet printers. More specifically, the present invention relates to a method and apparatus for inserting and removing ink containers from a receiving station within an inkjet printer.

Inkjet printers frequently make use of an inkjet printhead mounted within a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead.

One type of previously used printing system makes use of the ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. For the case where the ink supply is separately replaceable, the ink supply is replaced when exhausted. The printhead is then replaced at the end of printhead life. Regardless of where the ink supply is located within the printing system, it is critical that the ink supply provides a reliable supply of ink to the inkjet printhead.

There is an ever present need for inkjet printing systems that make use of replaceable ink containers that are easy to install and remove. The installation of the ink container should produce reliable fluidic connection to the printer. These ink containers should be relatively easy to manufacture, thereby tending to reduce the ink supply cost. Reduction of the ink supply cost tends to reduce the per page printing costs of the printing system. In addition, these ink containers should be compact and configured to be inserted into the inkjet printing system to maintain a relatively small overall height of the printing system allowing a low profile printing system.

SUMMARY OF THE INVENTION

One aspect of the present invention is a replaceable ink container for providing ink to an inkjet printing system. The inkjet printing system has a receiving station mounted to a scanning carriage. The receiving station has a fluid inlet and a pair of guide rails extending along either side of the fluid inlet. The replaceable ink container includes a fluid outlet configured for connection to the fluid inlet associated with the receiving station. Also included is a pair of outwardly extending guide rail engagement features. Each of the pair of guide rail engagement features are so disposed and arranged on the replaceable ink container for engagement with each of the pair of guide rails to guide the replaceable ink container in both horizontal and vertical directions into the receiving station. The pair of outwardly extending guide rail engagement features and the pair of guide rails cooperate to align the fluid outlet with the fluid inlet to establish fluid communication between the ink container and the receiving station.

Another aspect of the present invention is the guide features associated with the receiving station guide, the replaceable ink container moves first in a linear motion inwardly toward a backwall of the receiving station then in both an inward and downward motion toward the backwall and downwardly into the receiving station.

Yet another aspect of the present invention is a plurality of electrical contacts electrically connected to an electrical storage device. The ink container guide features are so disposed and arranged to engage the receiving station guide features to guide the replaceable ink container in first a linear direction toward a backwall then in a direction toward both the backwall and a bottom surface of the receiving station. The guide features on the ink container cooperate with the guide features associated with the receiving station to align the fluid outlet with the fluid inlet and to align the plurality of electrical contacts on the replaceable ink container with the plurality of electrical contacts on the replaceable ink container to establish both electrical and fluid connection between the ink container and the receiving station.

DETAILED DESCRIPTION OF THE PREFERRED EMBODIMENT

Figure 1:
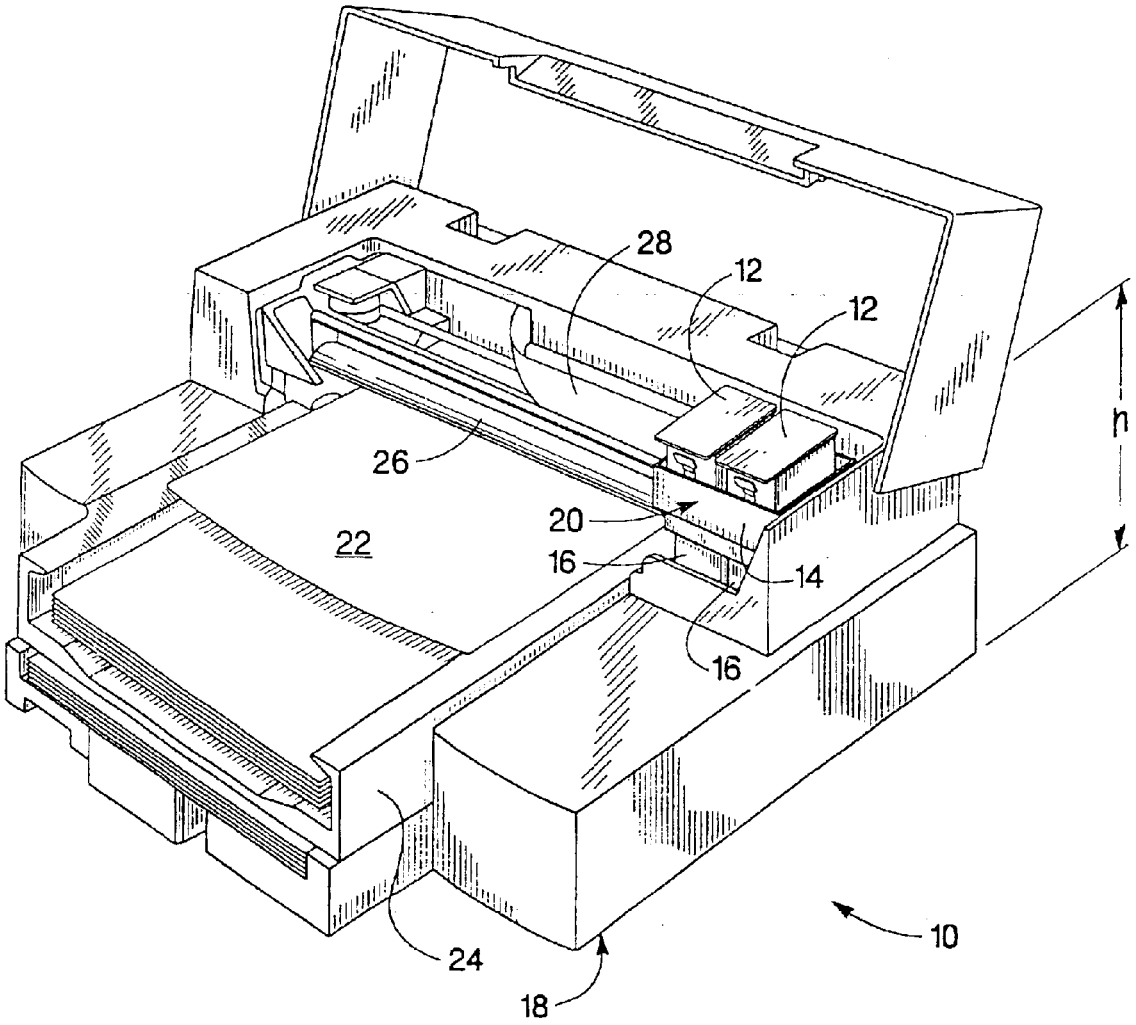
FIG. 1 is one exemplary embodiment of an ink jet printing system of the present invention shown with a copier opened to show a plurality of replaceable ink containers of the present invention.

FIG. 1 is a perspective view of one exemplary embodiment of a printing system 10 shown with its cover open, that includes at least one replaceable ink container 12 that is installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12. In one preferred embodiment the replaceable ink container 12, receiving station 14, and inkjet printhead 16 are each part of a scanning carriage that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

An important aspect of the present invention is the method and apparatus for inserting the ink container 12 into the receiving station 14 such that the ink container 12 forms proper fluidic and electrical interconnect with the printer portion 18. It is essential that both proper fluidic and electrical connection be established between the ink container 12 and the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 18. Information passed between the replaceable ink container 12 and the printer portion 18 includes, for example, information related to the compatibility of replaceable ink container with printer portion 18 and operation status information such as ink level information.

The method and apparatus of the present invention, as will be discussed with respect to FIGS. 2 through 9, depict those features which allow the replaceable ink container 12 to be inserted into the receiving station 14 in such a manner that reliable electrical and fluidic connection is established between the replaceable ink container 12 and the receiving station 14. In addition, the method and apparatus of the present invention allows for the insertion and removal of the replaceable printing component 12 from the printer portion 18 in a reliable fashion while allowing the overall height of the printer portion 18, represented by dimension designated as "h" in FIG. 1 to be a relatively small dimension, thereby providing a relatively low profile printing system 10. It is important that the printing system 10 have a low profile to provide a more compact printing system as well as to allow the printer portion to be used in a variety of printing applications.

Figure 2:
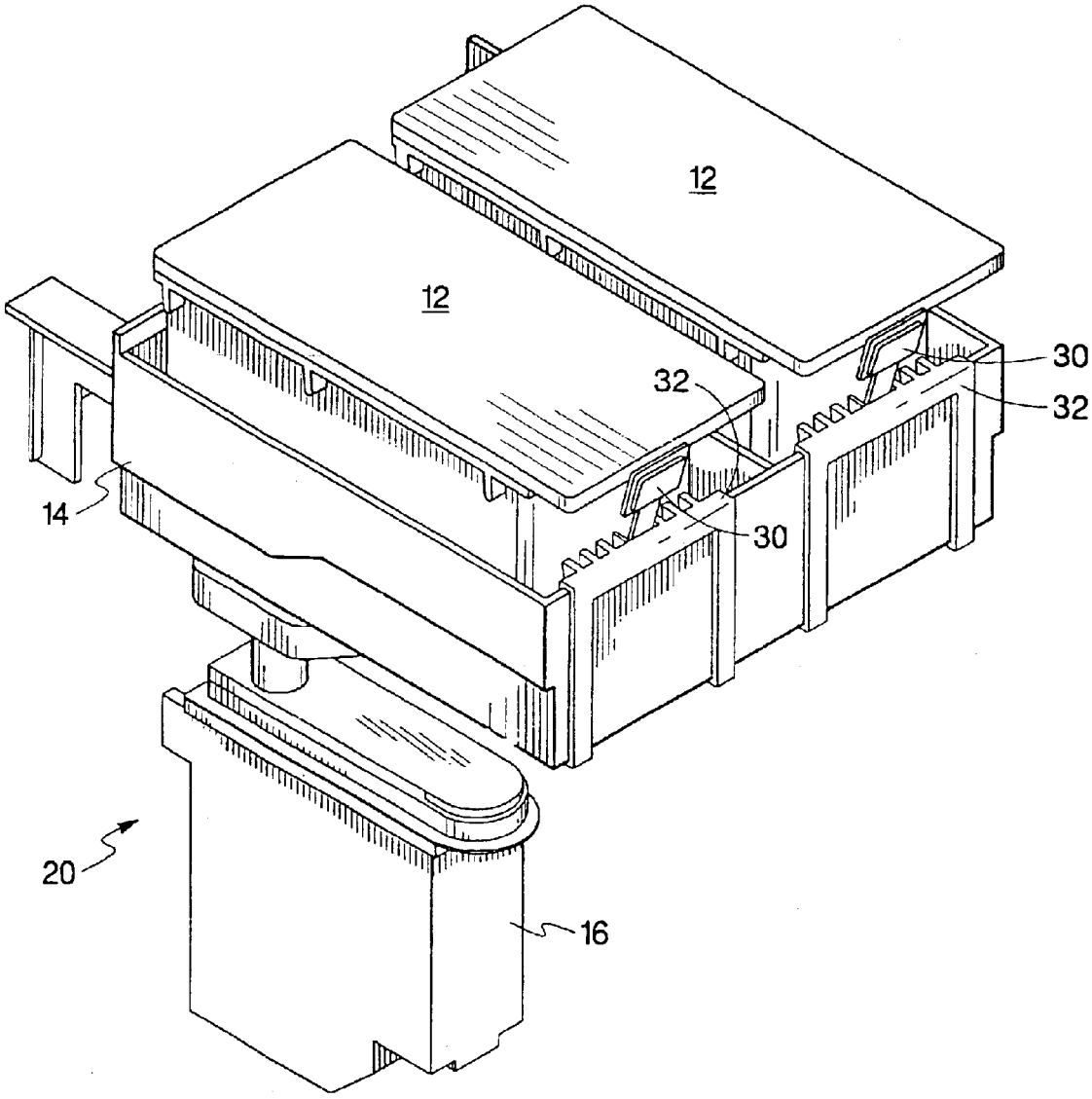
FIG. 2 is a greatly enlarged perspective view of a portion of a scanning carriage showing the replaceable ink containers of the present invention positioned in a receiving station that provides fluid communication between the replaceable ink containers and one or more printhead.

FIG. 2 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tricolor ink container containing three separate ink colors and a second ink container containing a single ink color. In this preferred embodiment, the tricolor ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The receiving station 14 shown in FIG. 2 is shown fluidically coupled to a single printhead 16 for simplicity. In the preferred embodiment, four inkjet printheads 16 are each fluidically coupled to the receiving station 14. In this preferred embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 3.

Each of the replaceable ink containers 12 includes a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 3:
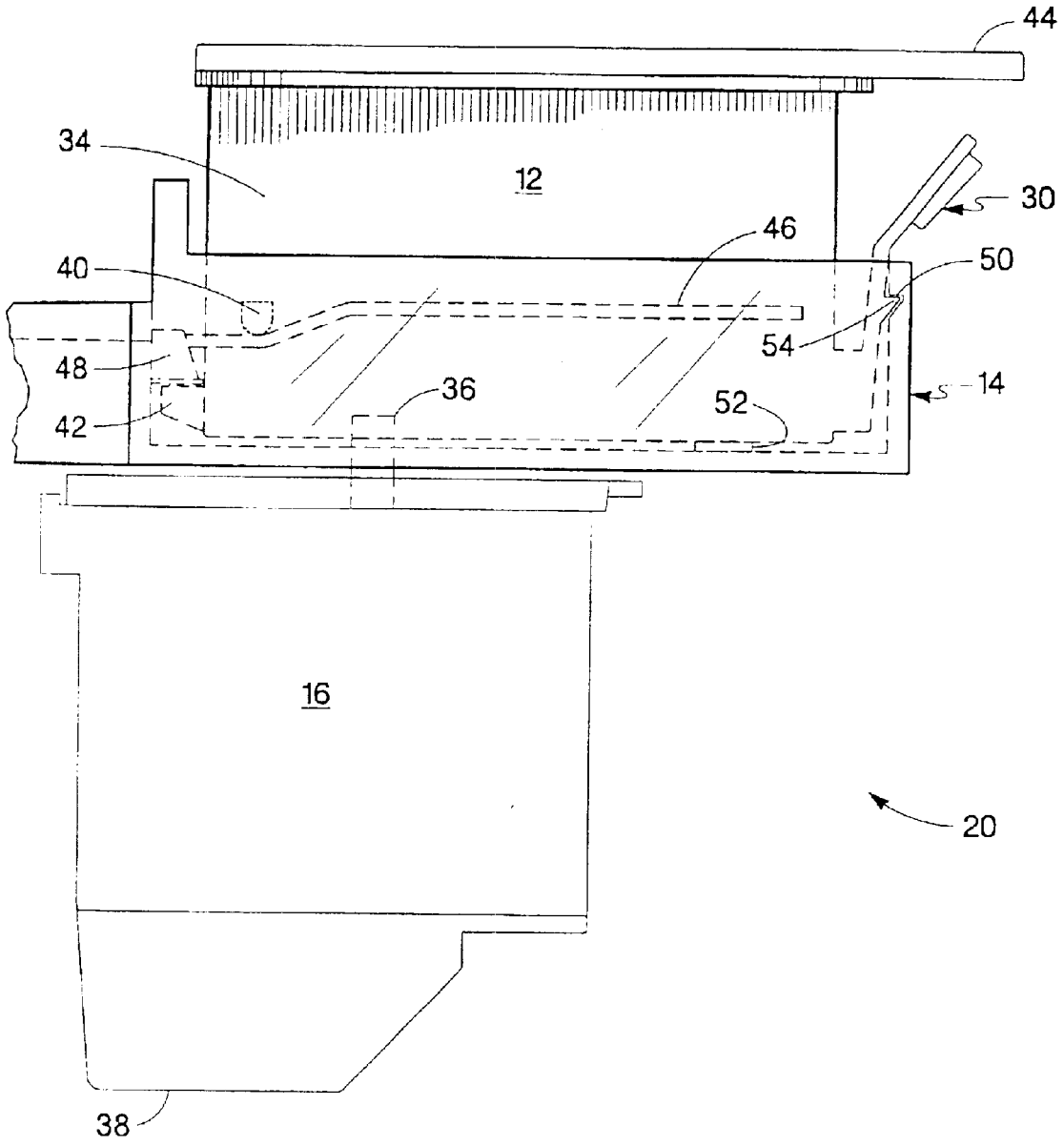
FIG. 3 is a side plan view of a portion of the scanning carriage showing guiding and latching features associated with each of the replaceable ink container and the receiving station for securing the replaceable ink container, thereby allowing fluid communication with the printhead.

FIG. 3 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in U.S. Patent Application entitled "Ink Reservoir for an Inkjet Printer" filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force within the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 3. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. As will be discussed, it is crucial that the ink container 12 be properly positioned within the receiving station 14 such that proper compression of the capillary member is accomplished when the ink container 12 is inserted into the receiving station. Proper compression of the capillary member is necessary to establish a reliable flow of ink from the ink container 12 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20 as will be discussed with respect to FIGS. 7*a*–7*c* and 8*a*–8*b*.

The receiving station 14 includes a guide rail 46, an engagement feature 48 and a latch engagement feature 50. The guide rail 46 cooperates with the guide rail engagement feature 40 of the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or trailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 4.

Figure 4:
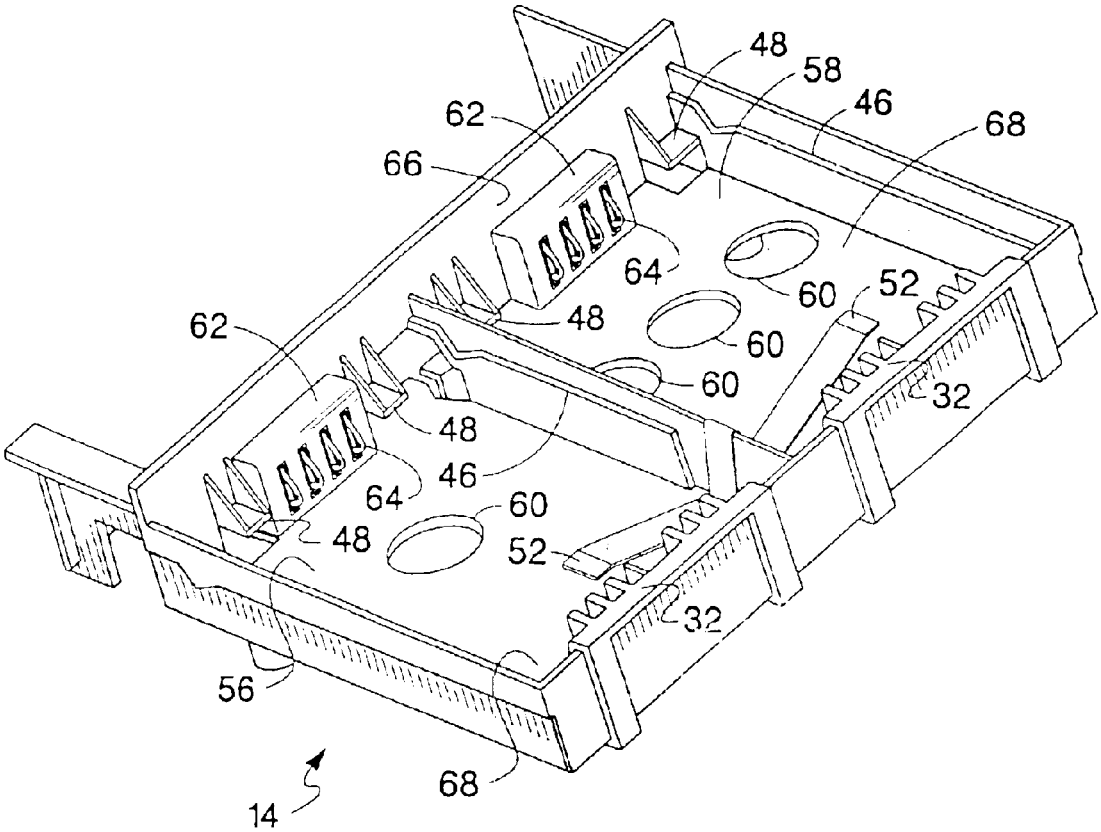
FIG. 4 is a receiving station shown in isolation for receiving one or more replaceable ink containers of the present invention.

FIG. 4 is a front perspective view of the ink receiving station 14 shown in isolation. The receiving station 14 shown in FIG. 4 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving the upright fluid interconnect 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts are an arrangement of four spring-loaded electrical contacts with proper installation of the replaceable ink container 12 into the corresponding bay of the receiving station 14. Proper engagement with each of the electrical connectors 62 and fluid interconnects 36 must be established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14. The leaf spring 52 provides a biasing force which tends to urge the ink container 12 upward from a bottom surface 68 of the receiving station 14. The leaf spring aids in the latching of the ink container 12 to the receiving station 14 as well as aiding the removal of the ink container 12 from the receiving station as will be discussed with respect to FIGS. 8 and 9.

Figure 5C:
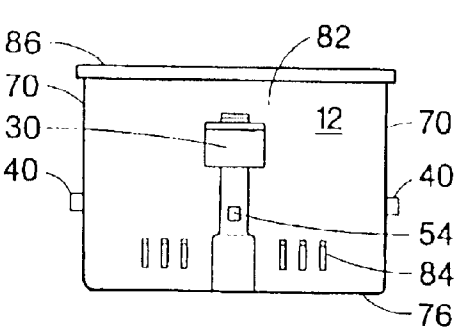
FIGS. 5*a*, 5*b*, 5*c*, and 5*d* are isometric views of a three-color replaceable ink container of the present invention shown in isolation.
Figure 5B:
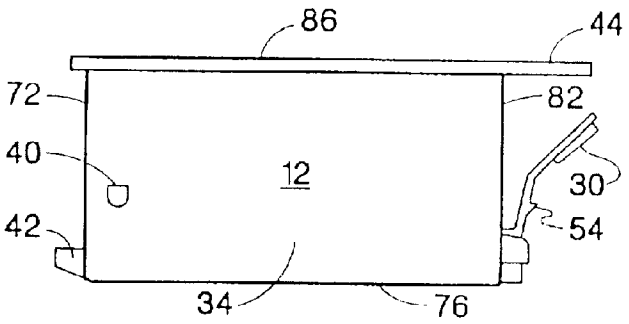
Figure 5A:
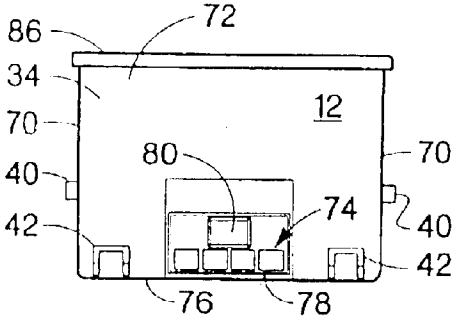
Figure 5D:
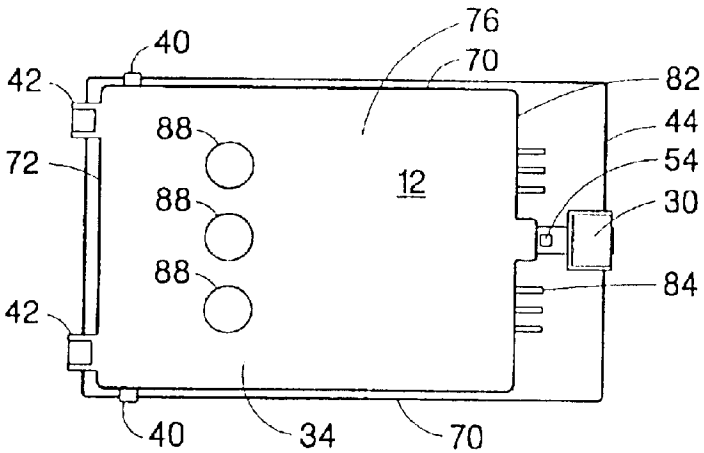

FIGS. 5*a*, 5*b*, 5*c*, and 5*d* show front plan, side plan, back plan, and bottom plan views, respectively, of the replaceable ink container 12 of the present invention. As shown in FIG. 5*a*, the replaceable ink container 12 includes a pair of outwardly projecting guide rail engagement features 40. In the preferred embodiment, each of these guide rail engagement features extend outwardly in a direction orthogonal to upright side 70 of the replaceable ink container 12. The engagement features 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Opposite the leading end 72 is a trailing end 82 shown in FIG. 5*c*. The trailing end 82 of the replaceable ink container 12 includes the latch feature 30 having an engagement hook 54. The latch feature 30 is formed of a resilient material which allows the latch feature to extend outwardly from the trailing end thereby extending the engagement feature outwardly toward the corresponding engagement feature associated with the receiving station 14. As will be discussed as the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or compatability with the corresponding receiving bay 56 and 58 within the receiving station 14.

Also included in the ink container 12 is the handle portion 44 disposed on a top surface 86 at the trailing edge 82 of the replaceable ink container 12. The handle 44 allows the ink container 12 to be grasped at the trailing edge 82 while being inserted into the appropriate bay of the receiving station 14.

Finally, the ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tri-color chamber, each of three fluid interconnects 36 extend into each of the fluid outlets 88 to provide fluid communication between each ink chamber and the corresponding print head for that ink color.

Figure 6:
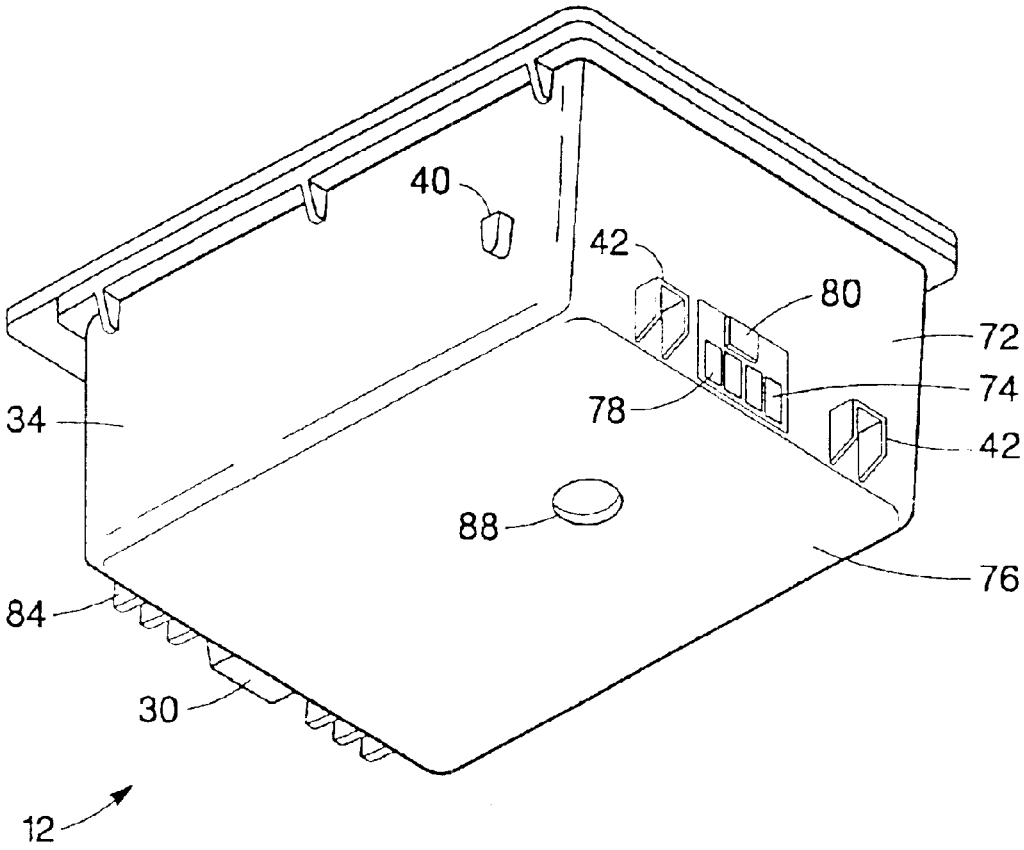
FIG. 6 is a perspective view of a single color replaceable ink container of the present invention.

FIG. 6 is a perspective view of a monochrome ink container positioned for insertion into the monochrome bay 56 in the receiving station 14 shown in FIG. 4. The monochrome ink container shown in FIG. 6 is similar to the tri-color ink container shown in FIGS. 5*a* through 5*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 7A:
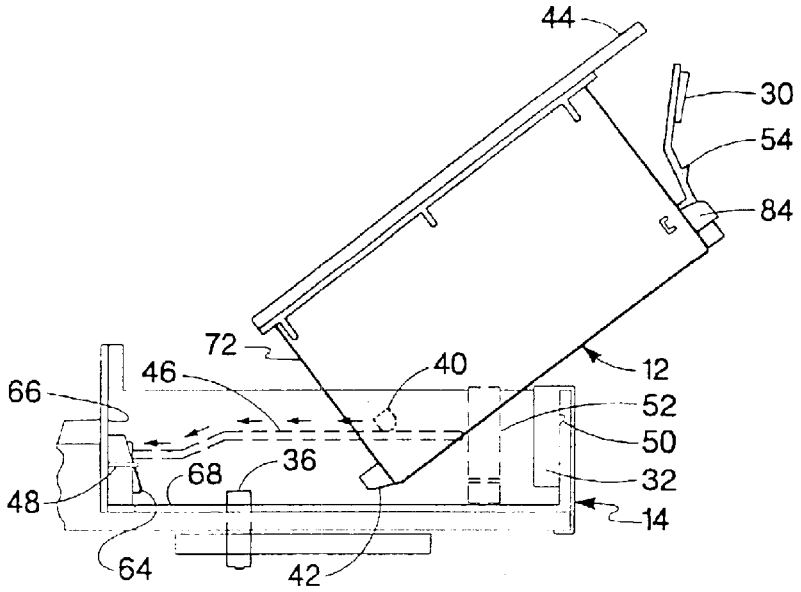
FIGS. 7*a*, 7*b*, and 7*c* depict the method of the present invention for inserting the replaceable ink container into the supply station.
Figure 7B:
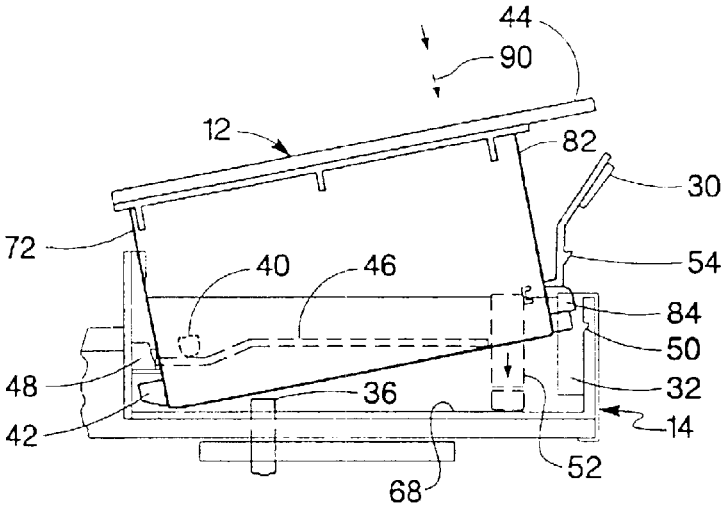
Figure 7C:
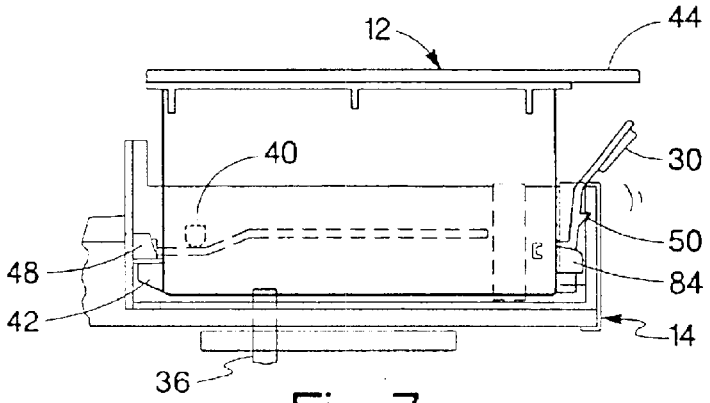

FIGS. 7*a*, 7*b*, and 7*c* is a sequence of figures to illustrate the technique of the present invention for inserting the replaceable ink container 12 into the receiving station 14 to form reliable electrical and fluidic connections with the receiving station 14.

FIG. 7*a* shows the ink container 12 partially inserted into the receiving station 14. In the preferred embodiment, the ink container 12 is inserted into the receiving station 14 by grasping the handle portion 44 and inserting the ink container into the receiving station with the leading edge or leading face 72 first. As the leading edge 72 enters the receiving station 14 the outwardly extending guide members 40 on the ink container engage each of the pair of guide rails 46. The guide rails 46 guide the ink container 12 in a horizontal or linear motion toward the back wall 66 of the receiving station 14. The guide rails 46 then guide the replaceable ink container in both a horizontal direction toward the back wall 66 and a vertical direction toward the bottom surface of the receiving station 14 such that the engagement feature 42 on the ink container 12 is received by a corresponding engagement feature 48 on the back wall 66 of the receiving station 14 as shown in FIG. 7*b*. The insertion of the ink container 12 requires only an insertion force to urge the ink container linearly along the guide rail 46. The gravitational force acting on the ink container 12 tends to cause the ink container to follow the guide rails 46 as the guide rails extend in a downward direction to allow engagement of engagement features 42 and 48. The guide rail engagement features 40 are preferably gently rounded surfaces to slide freely along the guide rails 46.

FIG. 7*b* shows the ink container 12 inserted into the receiving station 14 such that the engagement feature 42 is in engagement with the engagement feature 48 associated with the receiving station 14. A downward force is applied to the ink container 12 as represented by arrows 90 to compress the leaf spring 52 and to urge the trailing end 82 of the ink container 12 downwardly toward the bottom surface 68 of the receiving station 14. The keys 84 must properly correspond to the keying feature 32 on the receiving station 14. If the keys 84 on the ink container 12 do not correspond to the keying features 32, the keying system will prevent further insertion of the ink container 12 into the receiving station 14. This keying system made up of keys 84 and the keying features 32 prevent ink containers that are not compatible with the receiving station 14 from further insertion into the receiving station 14. Further insertion of the ink container 12 into the receiving station 14 could result in contact of the fluid interconnect 36 with the capillary member within the ink container 12, thereby contaminating the fluid interconnect 36 with incompatible ink. Incompatible ink mixing in the fluid interconnect 36 can result in precipitation which can damage the printhead 16. In addition to inks of incompatible chemistries, the ink container can have an incompatible color which can result in color mixing, thereby reducing the output print quality.

The keys 84 on the ink container 12 and the keying features 32 on the receiving station 14 allow for the complete insertion of the proper ink container 12 into the proper receiving station 14. The downward force applied to the trailing end 82 of the ink container 12 causes the ink container 12 to pivot about a pivot axis compressing the leaf spring 52, thereby moving the trailing edge 82 of the ink container 12 toward the bottom surface 68 of the receiving station 14. As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 7*c*.

With the ink container 12 properly secured in the receiving station 14 as shown in FIG. 7*c* the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. In the preferred embodiment, the ink container 12 when inserted into the receiving station 14 is oriented in a gravitational frame of reference so that a gravitational force acts on ink within the ink container 12 tending to draw ink toward the bottom surface 76 of the ink container 12. Thus ink within the ink container 12 is drawn to the bottom surface 76 where this ink is drawn toward the fluid interconnect 36 by capillary attraction thereby tending to reduce or minimize stranding of ink within the ink container 12.

Figure 8B:
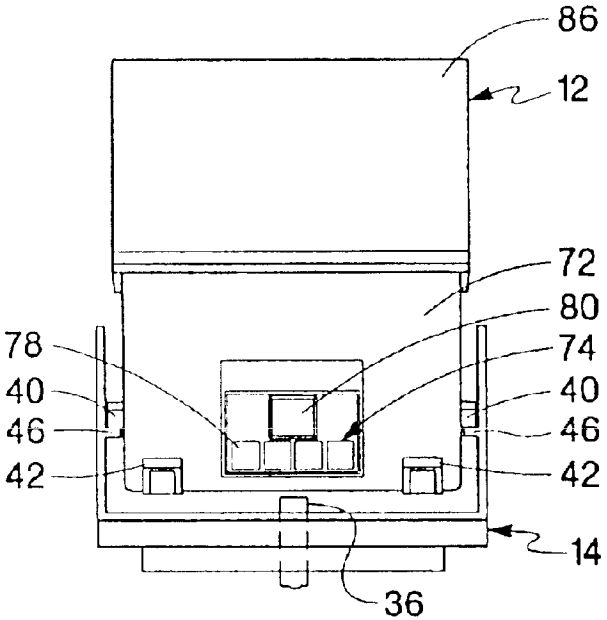
FIGS. 8*a* and 8*b* depict the passage of the replaceable ink container over an upstanding fluid inlet on the receiving station viewed from a side view and an end view, respectively.
Figure 8A:
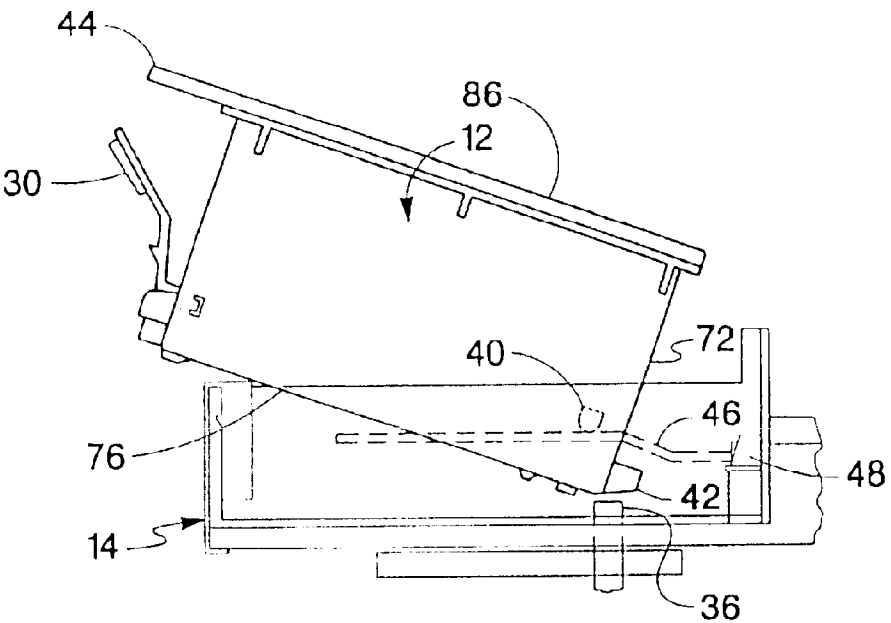

FIGS. 8*a* and 8*b* illustrate a position in the insertion process described with respect to FIGS. 7*a*, 7*b* and 7*c* wherein the leading edge 72 of the ink container 12 is positioned over the fluid interconnect 36. FIG. 8*a* depicts a side view with FIG. 8*b* showing an end view. It can be seen from FIGS. 8*a* and 8*b* that the guide feature 40 must be positioned on the ink container 12 low enough toward the bottom surface 76 of the ink container 12 such that the leading edge 72 of the ink container does not collide with the fluid interconnect 36 during insertion. Another constraint on the positioning of the guide member 40 is that the guide member 40 must be positioned sufficiently close to the top surface 86 of the ink container 12 to insure that the engagement feature 42 properly engages with the corresponding engagement feature 48 on the receiving station 14.

In addition, the outwardly extending guide members 40 on the ink container must extend outward sufficiently far to engage the guide rails 46. However, the outwardly extending guide members 40 should not extend too far outward such that the guide members 40 engage the upright sides in the receiving station 14, producing interference which produces friction and binding which resists insertion of the ink container 12 into the receiving station 14.

Figure 9A:
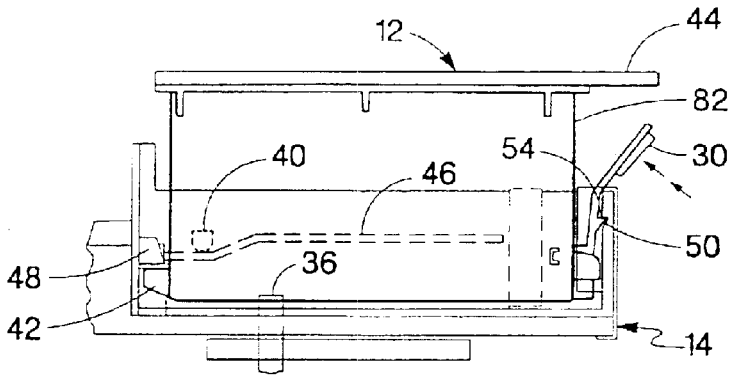
FIGS. 9*a*, 9*b*, and 9*c* depict a method of the present invention for removing the replaceable ink container from the receiving station.
Figure 9B:
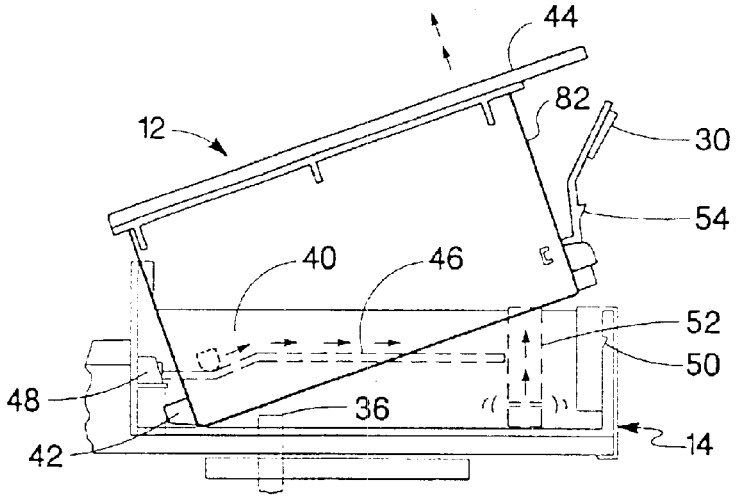
Figure 9C:
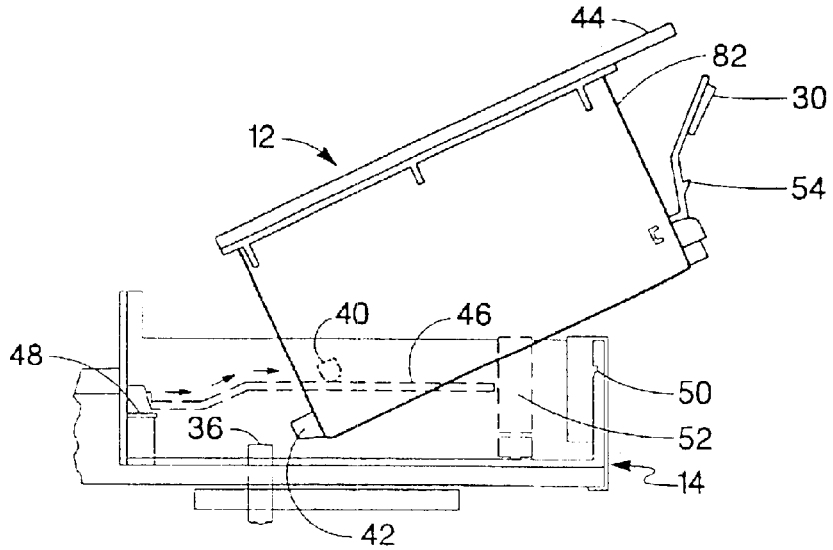

FIGS. 9*a*, 9*b*, and 9*c* illustrate the technique for removing the ink container 12 from the receiving station 14. The technique for removing the ink container 12 of the present invention begins with the release of the engagement feature from the corresponding engagement feature 50 on the receiving station 14 by urging the latch 30 toward the trailing surface 82. Once the trailing edge of the ink container 12 is released, the spring 52 urges the trailing edge of the ink container upward as shown in FIG. 9*b*. The ink container 12 can be grasped by handle 44 to retrieve the ink container 12 in a direction opposite the insertion direction. As the ink container 12 is withdrawn from the receiving station 14, the guide member 40 follows the guide rails 46 to lift the ink container, thereby preventing interference between the fluid interconnect 36 and the fluid outlet on the bottom surface of the ink container 12.

The ink container 12 of the present invention is configured to engage and interact with the receiving station 14 to guide the ink container 12 into the receiving station and form a reliable fluid and electrical connection with the receiving station 14. The technique of the present invention allows this insertion process to be relatively simple and easy to prevent improper insertion of the ink container 12. The customer grasps the ink container 12 by the handle portion 44 and slides the ink container 12 horizontally into the receiving station 14. The guide rails 46 and guide features 40 cooperate to properly guide the ink container 12 into the receiving station 14. The ink container 12 is pressed downwardly to latch the ink container 12 and achieve operational interconnection both electrically and fluidically between the ink container 12 and the receiving station 14.

What is claimed is:

1. A replaceable ink container for providing ink to an inkjet printing system, the inkjet printing system having a receiving station mounted to a scanning carriage, the receiving station having a plurality of corresponding electrical contacts, a fluid inlet and a pair of guide rails extending along either side of the fluid inlet, the replaceable ink container comprising:

a housing having a leading edge and a trailing edge relative to an insertion direction of the replaceable ink container into the receiving station, and a bottom surface;

a fluid outlet defined on the bottom surface and configured for connection to the fluid inlet associated with the receiving station;

a plurality of electrical contacts electrically connected to an electrical storage device, the plurality of electrical contacts disposed on the leading edge of the replaceable ink container and configured for connection to the plurality of corresponding electrical contacts disposed on the receiving station; and a pair of outwardly extending guide rail engagement features with each of the pair of guide rail engagement features so disposed and arranged for engagement with each of the pair of guide rails, such that the pair of guide rails guide the replaceable ink container into the receiving station first in only a horizontal direction, then in both the horizontal direction and a vertical direction, and finally in the horizontal direction to align the fluid outlet with the fluid inlet to establish fluid communication between the ink container and the receiving station, and to align each of the plurality of electrical contacts electrically connected to the electrical storage device with each of the plurality of corresponding electrical contacts disposed on the receiving station to establish electrical communication between the ink container and the receiving station.

2. The replaceable ink container of claim 1 wherein the pair of outwardly extending guide rail engagement features extend orthogonally from a surface of the replaceable ink container.

3. The replaceable ink container of claim 1 wherein the leading edge of the replaceable ink container comprises at least one engagement feature, and wherein the pair of outwardly extending guide rail engagement features are positioned sufficiently low on the replaceable ink container to prevent collision between the replaceable ink container and the fluid inlet during insertion, and the pair of outwardly extending guide rail engagement features are positioned sufficiently high on the replaceable ink container to ensure that the at least one engagement feature disposed on the leading edge properly engages with an engagement feature associated with the receiving station.

4. The replaceable ink container of claim 3 wherein the at least one engagement feature is a hook feature extending outwardly from the leading edge.

5. The replaceable ink container of claim 1 wherein the pair of outwardly extending guide rail engagement features extend in a direction orthogonal to the insertion direction.

6. The replaceable ink container of claim 1 wherein the replaceable ink container further comprises:

an engagement feature disposed on the leading edge, the engagement feature configured to engage corresponding engagement features associated with the receiving station; and a latch feature disposed on the trailing edge, the latch feature configured to engage a corresponding latch feature on the receiving station to secure the replaceable ink container to the receiving station.

7. The replaceable ink container of claim 6 wherein insertion of the replaceable ink container into the receiving station engages the engagement feature on the replaceable ink container with the corresponding engagement features on the receiving station, wherein with the engagement feature on the replaceable ink container engaged with the corresponding engagement features on the receiving station, the replaceable ink container is pivoted about a pivot axis to engage the latch feature with the corresponding latch feature on the receiving station.

8. The replaceable ink container of claim 6 wherein the latch feature on the replaceable ink container is configured so that when in engagement with the corresponding latch feature on the receiving station the latch feature overcomes a spring bias force acting on the trailing edge of the replaceable ink container to secure the replaceable ink container to the receiving station.

9. The replaceable ink container of claim 8, wherein in the unlatched position the spring bias force urges the trailing edge of the replaceable ink container in a direction away from the receiving station.

10. The replaceable ink container of claim 1 wherein the horizontal direction is in a direction orthogonal to a scan axis and the vertical direction is orthogonal to the horizontal direction.

11. A replaceable ink container for providing ink to an inkjet printing system, the replaceable ink container comprising:

a housing having a leading end relative to an insertion direction of the replaceable ink container into a receiving station of the inkjet printing system, a trailing end and a bottom end, the bottom end defining a fluid outlet configured for connection to a fluid inlet associated with the receiving station;

an electrical storage device coupled to the housing;

a plurality of electrical contacts mounted to the leading end of the housing and electrically connected to the electrical storage device, the plurality of electrical contacts configured for connection to a corresponding plurality of electrical contacts associated with the receiving station; and an ink container guide feature so disposed and arranged to engage receiving station guide features to guide the replaceable ink container along the insertion direction into the receiving station first in only a horizontal direction, then in both the horizontal direction and a vertical direction, and finally in the horizontal direction to align the fluid outlet with the fluid inlet and to align the plurality of electrical contacts with the corresponding plurality of electrical contacts to establish fluid and electrical communication between the ink container and the receiving station.

12. The replaceable ink container of claim 11, and further comprising an engagement feature disposed on the leading end, wherein insertion of the replaceable ink container into the receiving station engages the engagement feature on the replaceable ink container to a corresponding engagement feature on the receiving station and allows the replaceable ink container to move in a pivot motion about a pivot axis to engage the fluid outlet with the fluid inlet.

13. The replaceable ink container of claim 11, and further comprising:

an engagement feature disposed on the leading end configured to engage a corresponding engagement feature associated with the receiving station; and a latch feature disposed on the trailing end, the latch feature having a latched position, wherein the latch feature engages a corresponding latch feature on the receiving station resisting a spring bias force acting on the trailing end of the replaceable ink container to secure the replaceable ink container to the receiving station, and an unlatched position.

14. The replaceable ink container of claim 13 wherein in the unlatched position the spring bias force urges the trailing end of the replaceable ink container away from the receiving station to allow removal of the replaceable ink container from the receiving station.

* * * * *